US007278382B1

(12) United States Patent
Kyuma et al.

(10) Patent No.: US 7,278,382 B1
(45) Date of Patent: Oct. 9, 2007

(54) WATER-COOLED TWO-CYCLE ENGINE

(75) Inventors: Katsunori Kyuma, Hamamatsu (JP); Shintaro Yagi, Hamamatsu (JP)

(73) Assignee: Suzuki Motor Corporation, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 11/420,398

(22) Filed: May 25, 2006

(51) Int. Cl.
*F02F 1/40* (2006.01)

(52) U.S. Cl. ..... 123/41.82 R; 123/193.2

(58) Field of Classification Search ..... 123/41.31, 123/193.2, 41.82 R, 295
See application file for complete search history.

(56) References Cited

U.S. PATENT DOCUMENTS 4,635,591 A * 1/1987 Hledin ..... 123/41.82 R
4,844,025 A * 7/1989 Sheaffer ..... 123/310
5,163,396 A * 11/1992 Fukuda et al. ..... 123/298
6,748,917 B1 * 6/2004 Hoffmann et al. ..... 123/295

FOREIGN PATENT DOCUMENTS

DE 10142777 A1 * 4/2002
JP 59-180067 A 10/1984
JP 2002-339745 A 11/2002

* cited by examiner

*Primary Examiner*—Noah P. Kamen
(74) *Attorney, Agent, or Firm*—Darby & Darby

(57) ABSTRACT

A cooling structure of a water-cooled two-cycle parallel multicylinder engine includes: an exhaust port in a cylinder block; an air intake port disposed in a crankcase below the exhaust port; a water pump disposed in the crankcase in an opposite side of the exhaust port; a first cooling water passage introducing cooling water discharged from the water pump to a cooling water jacket of a cylinder head; and a second cooling water passage introducing a part of the cooling water discharged from the water pump to a cooling water jacket below the exhaust port, the second cooling water passage being provided in the crankcase.

5 Claims, 13 Drawing Sheets

WATER-COOLED TWO-CYCLE ENGINE

BACKGROUND OF THE INVENTION

1. Field of the Invention

The present invention relates to a cooling structure of, in particular, a water-cooled two-cycle parallel multicylinder engine mounted on a vehicle, and to an ignition device for the same.

2. Description of the Related Art

A structure of an engine mounted on a small-sized snow vehicle such as a snowmobile, for example, is relatively simple, and a two-cycle engine which is lightweight, compact, and high-power has become a mainstream. For a two-cycle engine generally used in the snowmobile, a water-cooled engine is adopted, which prevents an overheat or an overcool and achieves an enhanced output by stably cooling the engine, and is also effective in suppressing noise.

In the two-cycle engine, as disclosed in Japanese Patent Application Laid-open No. Sho 59-180067 for example, cooling water cooled by a heat exchanger (radiator) flows through a thermostat integrated with a crankcase and is first made flow to a cylinder head by a water pump orthogonal to a crank axis. Subsequently, the cooling water flows to a cylinder and the crankcase, and then is returned to the heat exchanger.

Incidentally, in an engine of this kind, as for an ignition device in particular, an ignition plug thereof is generally disposed in a central portion of a combustion chamber. Hereby, flame is to spread evenly in the entire combustion chamber.

On the other hand, in an engine with a large cylinder bore in particular, combustion may not always be sufficiently performed with only a single ignition plug disposed in a central portion of a combustion chamber. Then, without modification, residual air-fuel mixture flows to an exhaust, causing a problem such that purification of exhaust gas becomes difficult.

Thus, conventionally, there is a means in which, for example, a plurality of ignition plugs per one cylinder are disposed to purify exhaust gas and to improve combustion. As disclosed in Japanese Patent Application Laid-open No. 2002-339745, for example, in a two-cycle engine, a plurality of ignition plugs are set in a central portion of a combustion chamber and in a position radial from the central portion.

However, in the conventional two-cycle engine or the cooling system thereof, cooling water is effective in cooling a cylinder head which becomes the highest temperature, but it is a structure such that the cooling water once warmed by the cylinder head flows to a periphery of an exhaust port which becomes the second highest temperature. Therefore, the structure is disadvantageous for a peripheral region of the exhaust port, in terms of a cooling effect.

Additionally, regarding the layout, even if the cooling water is made flow from the cylinder head, the cooling effect can be obtained in a vicinity of an upper portion of the exhaust port, but the water does not flow to a lower portion of the exhaust port, thereby forming a pouch shape. That is, it is a structure such that the cooling water is not distributed unless the water is drained to the outside of a throttle body and the like.

Further, in order to cool as far as the lower side of the exhaust port sufficiently, an amount of the water to be drained to the outside must be increased. Additionally, the drained water must be returned to the water pump in the interest of a hydraulic pressure, and as a result, warm water circulates and causes to reduce a cooling capability as the engine as a whole.

In a union structure in particular in which water is drained out of an engine at a time of engine disassembly and the like, the water cannot always be sufficiently drained due to a layout. As a result, the structure causes the water remaining in a water jacket of a crankcase runs to the inside of the engine (crankcase, in particular) when a cylinder is disengaged from the crankcase. In such a case, it becomes necessary in consequence that the entire engine is disassembled, significantly affecting maintainability.

As for the ignition device of the engine, though disposing the plurality of ignition plugs per one cylinder as described above improves a combustion efficiency and purifies exhaust gas, a relation between a flow of the cooling water of the cylinder head and disposed positions of the ignition plugs becomes a problem in a case of the water-cooled engine in particular. That is, if the plurality of ignition plugs are disposed, they may hinder the flow of the cooling water by contrast. On the other hand, in a case of a single ignition plug, a good combustion may not always be performed as described above.

Also, depending on a disposing method (position) of the plurality of ignition plugs, the ignition plugs themselves or attachment/detachment directions of plug caps may overlap among the cylinders. Thus, in the conventional ignition devices, the fact is that improving both combustion and a cooling capability or a handlability and the like is not always easy.

SUMMARY OF THE INVENTION

The present invention is made in view of the above circumstances and its object is to provide a cooling structure of a two-cycle engine capable of enhancing a cooling capability validly and effectively and of realizing simplification and downsizing, and further an ignition device capable of achieving an improved combustion and also of enhancing the cooling capability and the like.

A cooling structure of a two-cycle engine of the present invention is a cooling structure of a water-cooled two-cycle parallel multicylinder engine mounted on a vehicle and includes: an exhaust port in a cylinder block; an air intake port disposed in a crankcase below the exhaust port; a water pump disposed in the crankcase in an opposite side of the exhaust port; a first cooling water passage introducing cooling water discharged from the water pump to a cooling water jacket of a cylinder head; and a second cooling water passage introducing a part of the cooling water discharged from the water pump to a cooling water jacket below the exhaust port, the second cooling water passage being provided in the crankcase.

Additionally, in the cooling structure of the two-cycle engine of the present invention, the second cooling water passage is formed between cylinders of the crankcase and cooling water outlets directed to the right and left exhaust ports are provided at an end portion of the second cooling water passage.

Additionally, in the cooling structure of the two-cycle engine of the present invention, the cylinder is inclined in a vehicle mounted state and the exhaust port is disposed in a top surface side of an inclined engine while the water pump is disposed in a lower surface side of the engine.

Additionally, in the cooling structure of the two-cycle engine of the present invention, the engine is mounted on a snow vehicle in a manner that the exhaust port of the engine faces a front of the vehicle.

Additionally, an ignition device of a two-cycle engine of the present invention is an ignition device of a water-cooled two-cycle engine mounted on a vehicle and includes two ignition plugs parallelly disposed forward and backward along a vehicle traveling direction in one cylinder.

Additionally, in the ignition device of the two-cycle engine of the present invention, one of the ignition plugs is disposed in a central portion of a combustion chamber formed in a cylinder head and the other of the ignition plugs is disposed in a scavenging port side opposed to an exhaust port formed in a cylinder block, respectively.

Additionally, the ignition device of the two-cycle engine of the present invention further includes a guide rib provided in a cooling water jacket formed in the cylinder head, the guide rib regulating a flow of cooling water so that the cooling water flows from the exhaust port side to the scavenging port side.

Additionally, in the ignition device of the two-cycle engine of the present invention, the engine is a multicylinder engine, and a crankshaft is disposed in a vehicle width direction and a cylinder is mounted to be inclined, the exhaust port being provided in an upper portion side of the inclined cylinder.

Additionally, in the ignition device of the two-cycle engine of the present invention, the engine is mounted on a snow vehicle in a manner that the exhaust port faces a front of the vehicle.

DETAILED DESCRIPTION OF THE PREFERRED EMBODIMENTS

Hereinafter, preferred embodiments in a cooling structure of a two-cycle engine and an ignition device thereof according to the present invention will be described with reference to the drawings.

Figure 1:
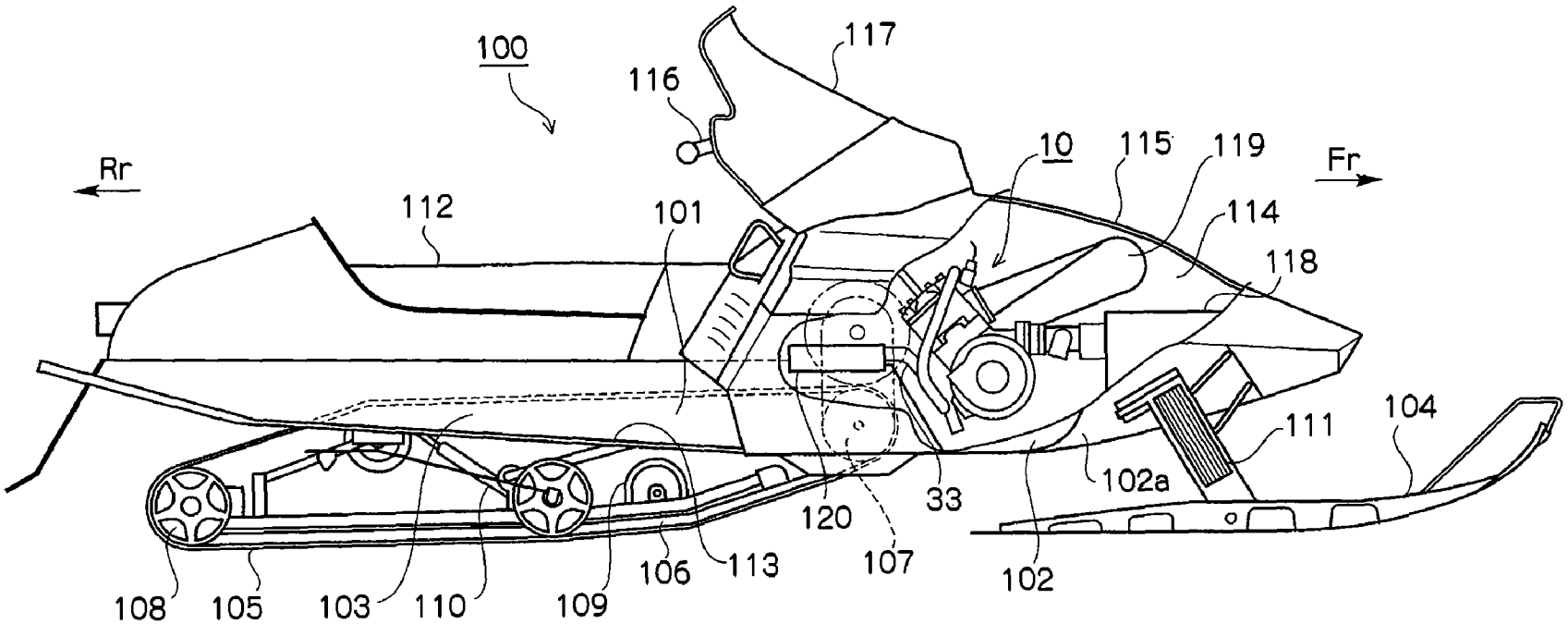
FIG. 1 is a side view showing an example of a snow vehicle to which a cooling structure of a two-cycle engine according to the present invention is applied.

FIG. 1 shows a snow vehicle 100 as an application example of the present invention. Here, first, a whole schematic construction of the snow vehicle 100 will be described. In the snow vehicle 100, a vehicle body frame 101 extending in a forward and backward direction has a front frame 102 and a rear frame 103, and under the front frame 102, a pair of right and left sleds 104 for steering are pivotally supported in a manner to be directed in a right and left direction, while under the rear frame 103, a crawler 106 for driving in which a track belt 105 is circulated is disposed. Incidentally, in FIG. 1, a front of the vehicle of the snow vehicle 100 is indicated by an arrow Fr and a rear of the vehicle is indicated by an arrow Rr, respectively.

The crawler 106 includes a driving wheel 107 disposed on a front end of the rear frame 103, a follower wheel 108 disposed on a rear end, a plurality of intermediate wheels 109, a suspension mechanism 110, and a track belt 105 wound around peripheries of the respective wheels and circulated.

The vehicle body frame 101 has a monocoque frame structure, and in the front frame (engine mount frame) 102 on which a later-described engine unit 10 and its attendant device and the like are mounted, a fore of a main portion 102*a* of the front frame 102 is formed to project upward to accommodate an upper portion of a front suspension 111 for supporting the sled 104 for steering. Additionally, the vehicle body frame 101 has a form in which a rear of the main portion 102*a* of the front frame 102 uprises obliquely backward upward so as to accommodate around an upper part of the driving wheel 107 of the crawler 106, and the front frame 102 is formed continually and integrally with the rear frame 103.

The rear frame 103 is constructed also as a cover accommodating the entire crawler 106 thereunder and is disposed to extend to a rear end portion in the forward and backward direction of the vehicle. Additionally, a saddle type seat 112 is disposed above the rear frame 103 while steps 113 formed lower than the seat 112 by one step are disposed on both sides of the seat 112 in a vehicle width direction.

There is provided a front cover 115 forming an engine room 114 in a front part of the snow vehicle 100, and there is provided to stand upright a steering shaft in an almost central portion in the vehicle width direction between the seat 112 and the front cover 115. On an upper end of the steering shaft, a bar handle 116 is disposed to extend to right and left in a horizontal direction in a manner to be inclined slightly backward. On a front position near the bar handle 116, a windshield 117 is disposed to stand, and from a base portion of the windshield 117, the front cover 115 gently declines toward the front in almost a streamline, having a substantial shape of a reversed bottom of a ship. The sled 104 for steering can be operated by the bar handle 116 via the steering shaft. Incidentally, a head light (head lamp) is equipped in a central portion in the vehicle width direction of the base portion of the windshield 117.

Next, a vicinity of the engine unit 10 according to the embodiment of the present invention will be described. In this embodiment, the snow vehicle 100 is provided with a two-cycle parallel multicylinder (two-cylinder, in this example) engine, and is to transmit a motive power of the engine to the driving wheel 107 to drive the track belt 105 to travel.

As shown in FIG. 1, the engine unit 10 is mounted on the snow vehicle 100 in a manner that its cylinder is inclined backward. In this case, inside the engine room 114, an air cleaner device 118 is mounted in a front of the engine unit 10 to take in air from the front portion of the engine. Additionally, an exhaust pipe 119 is also disposed in the front of the engine unit 10 in order to exhaust combustion gas from the front portion of the engine. In this example, a water-cooled type engine is used, and a heat exchanger 120 for the engine is disposed in a rear of the engine.

Figure 2:
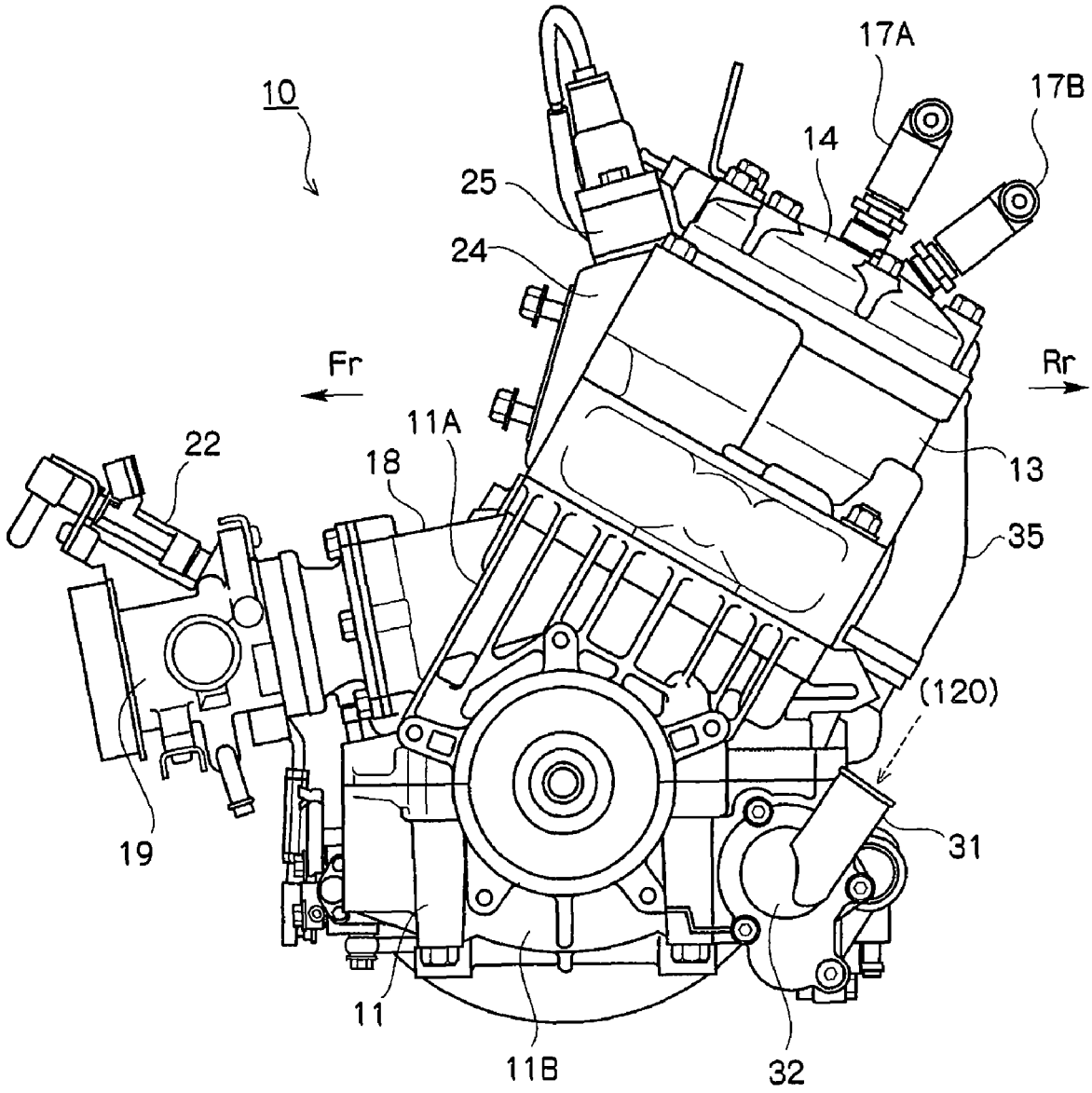
FIG. 2 is an external side view showing an example of a two-cycle engine in an embodiment of the present invention.
Figure 3:
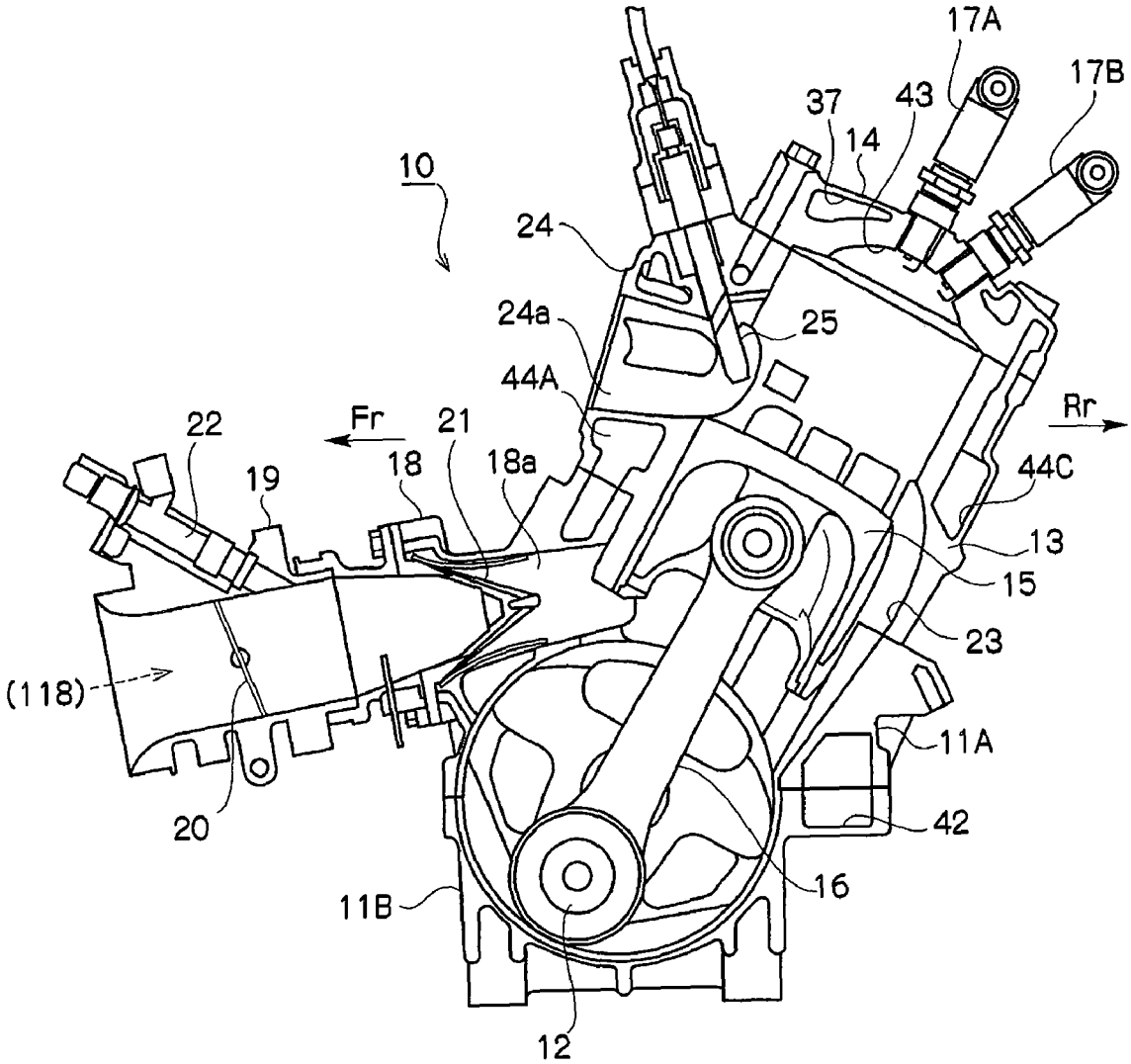
FIG. 3 is a sectional side view of the two-cycle engine in the embodiment of the present invention.
Figure 4:
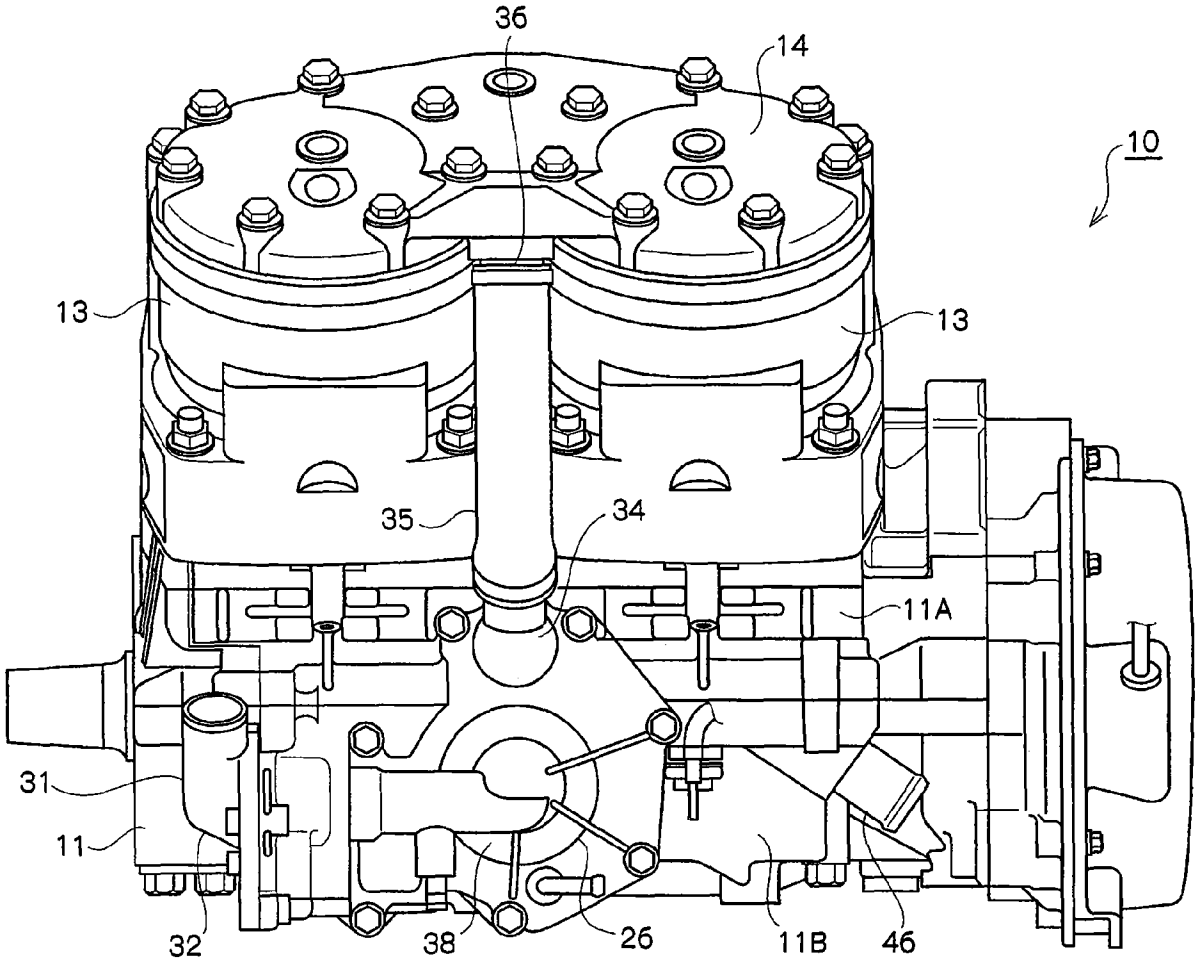
FIG. 4 is a backside perspective view of the two-cycle engine in the embodiment of the present invention.

In a basic structure of the engine unit 10, with reference to FIG. 2 to FIG. 4, a crankcase 11 is constituted with a crankcase upper 11 A and a crankcase lower 11B, and a crankshaft 12 is supported on a joining face therebetween. The crankshaft 12 is disposed in the vehicle width direction (right and left direction) of the snow vehicle 100, and two cylinders are parallelly disposed along an axis direction of the crankshaft 12 (FIG. 4). With an upper portion of the crankcase upper 11A, the cylinders 13 are combined, and with the cylinders 13, cylinder heads 14 are combined. As described above, the cylinders 13 (and the cylinder heads 14) are inclined toward the rear Rr as shown in FIG. 2 and the like.

A piston 15 reciprocatably accommodated in the cylinder 13 is coupled with the crankshaft 12 via a connecting rod 16. There are two ignition plugs 17A, 17B parallelly disposed on the cylinder head in the forward and backward direction, the ignition plug 17A (Fr side) being disposed on almost a cylinder axis. In a front portion of the crankcase 11 (crankcase upper 11A), an air intake manifold 18 is provided to project, and via an air intake port 18*a* inside thereof, air-fuel mixture is supplied to the crankcase 11. The air intake port 18*a* is connected to the air cleaner device 118 via an air intake pipe 19 so that an air intake amount from the air cleaner device 118 is controlled by a throttle valve 20. A lead valve 21 is attached to an inlet of the air intake port 18*a*, and a fuel injector 22 is disposed to the air intake pipe 19.

The crankcase 11 communicates with the cylinder 13 via a plurality of boost ports 23 disposed around the cylinder 13. On a front upper portion of the cylinder 13, an exhaust manifold 24 is provided to project, and combustion gas is exhausted from an exhaust port 24*a*. The exhaust port 24*a* is open toward the front Fr similarly to the air intake port 18*a*. The exhaust port 24*a* is connected to the exhaust pipe 119 so that an exhaust amount exhausted to the exhaust pipe 119 is controlled by an auxiliary valve 25.

Figure 5:
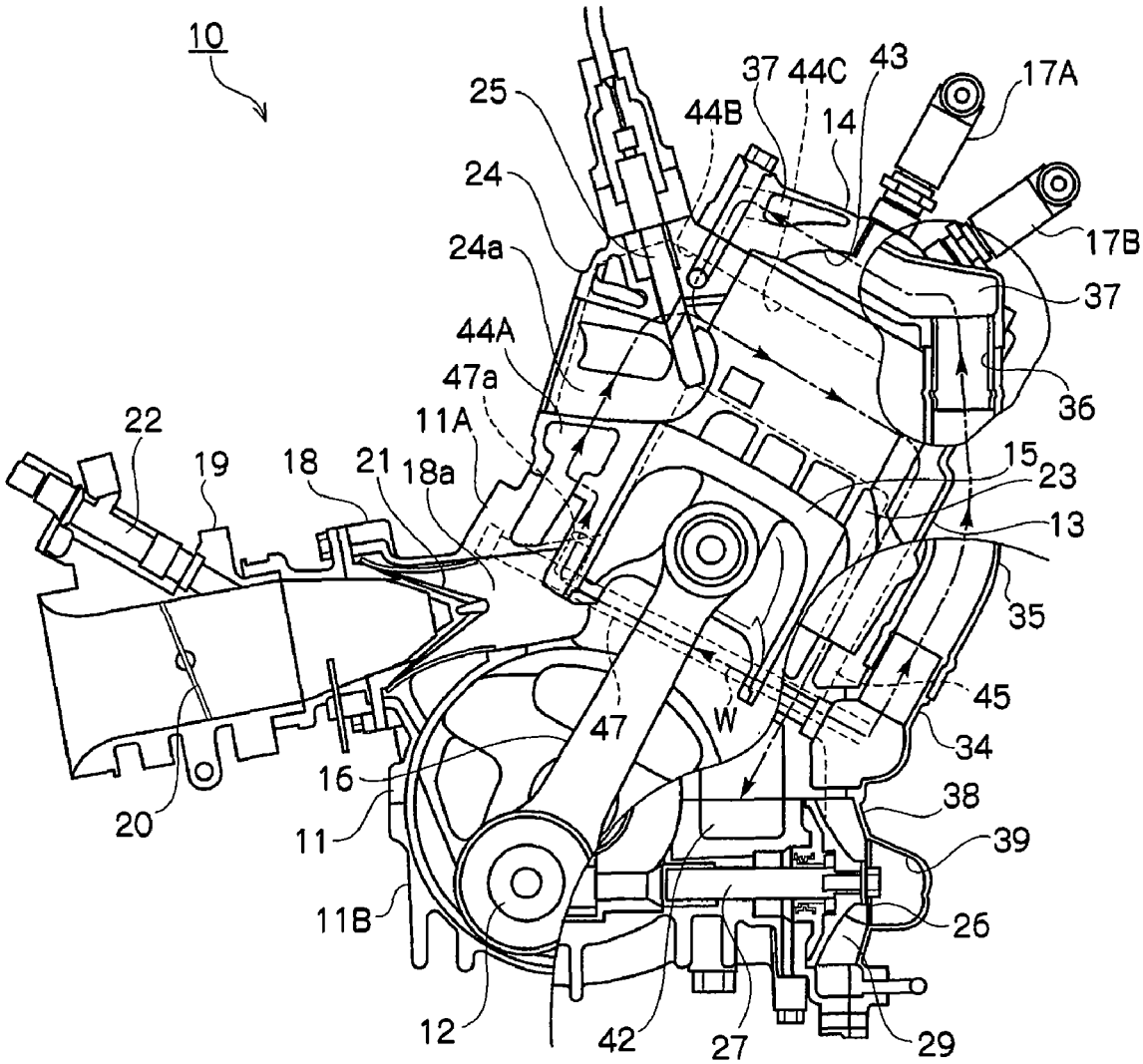
FIG. 5 is a sectional side view of the two-cycle engine in the embodiment of the present invention.

Next, as shown in FIG. 5 and the like, a water pump 26 is disposed in the crankcase 11 (crankcase lower 11B) of an opposite side of the exhaust port 24*a*, that is, of a rear Rr side. As described later, in this structure, a cooling water jacket is formed around the cylinders 13 and the cooling water discharged from the water pump 26 is distributed to the cooling water jacket.

Figure 6:
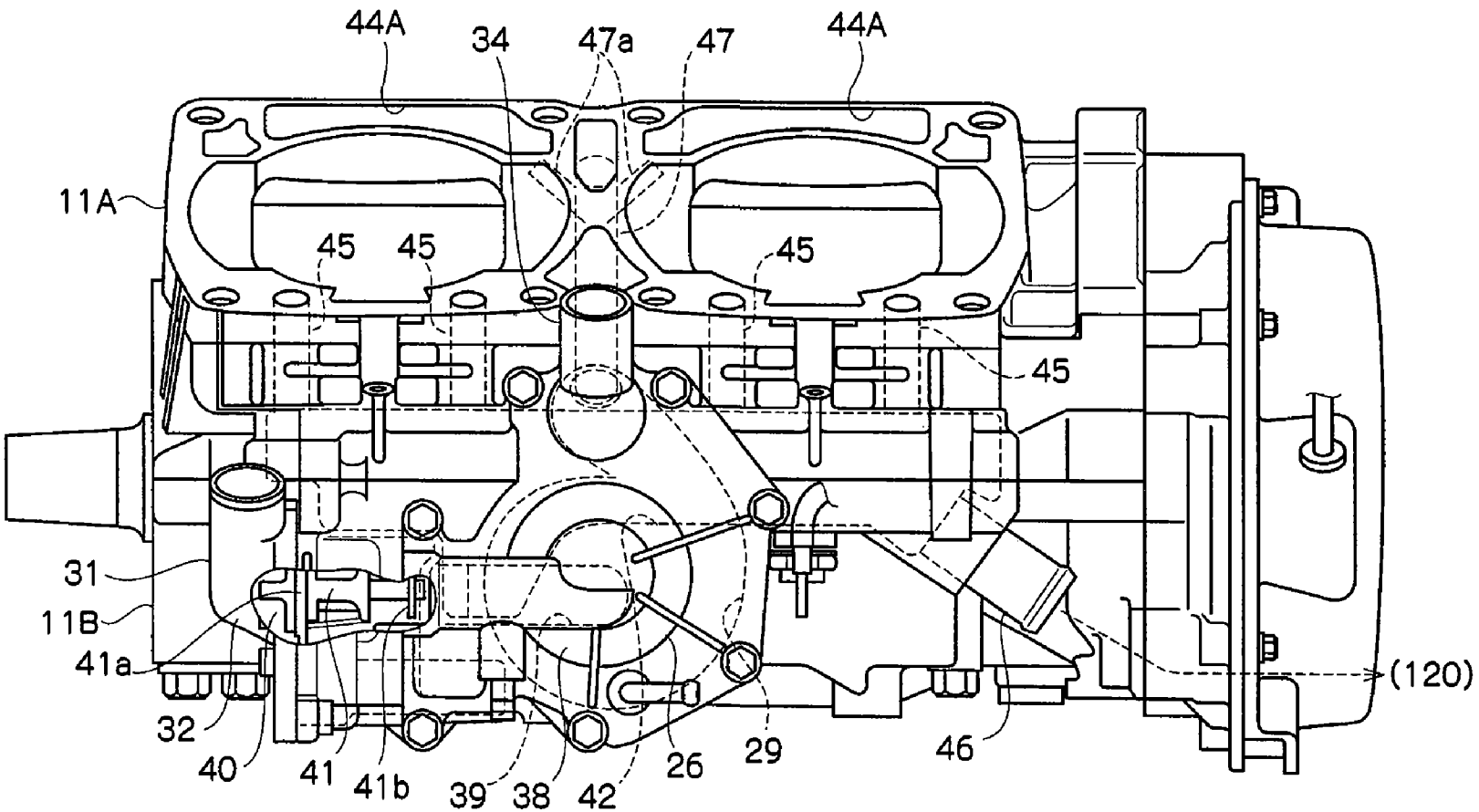
FIG. 6 is a backside perspective view of a vicinity of a crankcase of the two-cycle engine in the embodiment of the present invention.
Figure 7:
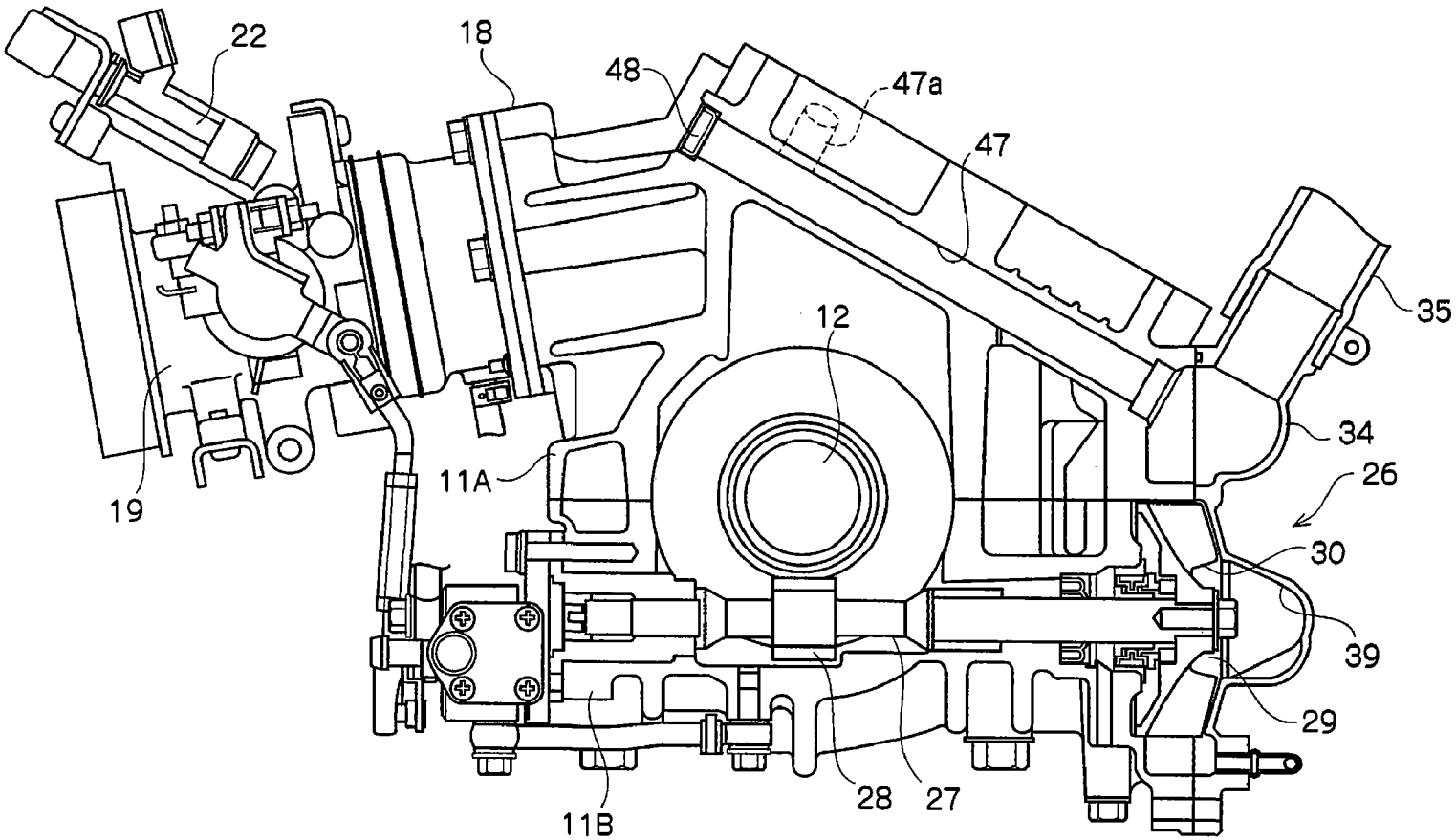
FIG. 7 is an external side view of the vicinity of the crankcase of the two-cycle engine in the embodiment of the present invention.

The water pump 26 is disposed on a rear surface of the crankcase lower 11B at almost a center of the two cylinders (cylinders 13) as shown in FIG. 4, FIG. 6 and the like. In the crankcase lower 11B, as shown in FIG. 7, a pump driving shaft 27 is disposed almost perpendicularly to an axial center direction of the crankshaft 12 and almost in a horizontal direction such that the pump driving shaft 27 is rotary driven by a motive power of the crankshaft 12 via a screw gear 28 which is provided integrally to the pump driving shaft 27 at a position opposed to the crankshaft 12.

The pump driving shaft 27 is coupled with the water pump 26, and drives the water pump 26. That is, in a pump chamber 29 provided on the rear surface of the crankcase lower 11B, an impeller 30 pivotally fit to the pump driving shaft 27 is accommodated and the impeller 30 rotates in the pump chamber 29. Near the water pump 26, at a cooling water supplying side of the water pump 26 is disposed a thermostat cap 32 to which a cooling water inlet portion 31 for introducing cooling water to the pump is provided to project, and the cooling water inlet portion 31 is connected to the heat exchanger 120 via a cooling water hose 33 (see FIG. 1).

In a cooling water discharging side of the water pump 26, a cooling water outlet portion 34 for discharging cooling water is formed to project, which is connected to a water jacket 37 being a cooling water passage formed inside the cylinder head 14 via a cooling water hose 35 (first cooling water passage) and a cooling water inlet portion 36.

A pump cover 38 of the water pump 26 constitutes a housing of the water pump 26, and is constructed also to be a jacket cover of the crankcase lower 11B, constituting a cooling water passage 39 thereinside. In a cooling water passage 40 to which the cooling water inlet portion 31 of the crankcase lower 11B is provided, there is provided a thermostat 41 controlling an amount of cooling water in response to a temperature of the cooling water, and the thermostat cap 32 is disposed in a manner to cover the thermostat 41. The thermostat 41 includes a main valve 41*a* controlling introduction of the cooling water supplied to the water pump 26 from the heat exchanger 120, and a sub valve 41*b* controlling introduction of the cooling water which is bypassed from an engine main body and directly supplied to the water pump 26.

The cooling water passage 40 is communicated with the cooling water passage 39 of the pump cover 38 via a communication hole, and is communicated with a water jacket 42 (warm water jacket) formed between the crankcase upper 11A and the crankcase lower 11B, via a cooling water bypass passage formed on a wall portion of the crankcase lower 11B. The above-described cooling water bypass passage is formed to open at a position opposed to the sub valve 41*b* and is opened/closed by the sub valve 41*b*.

Figure 8:
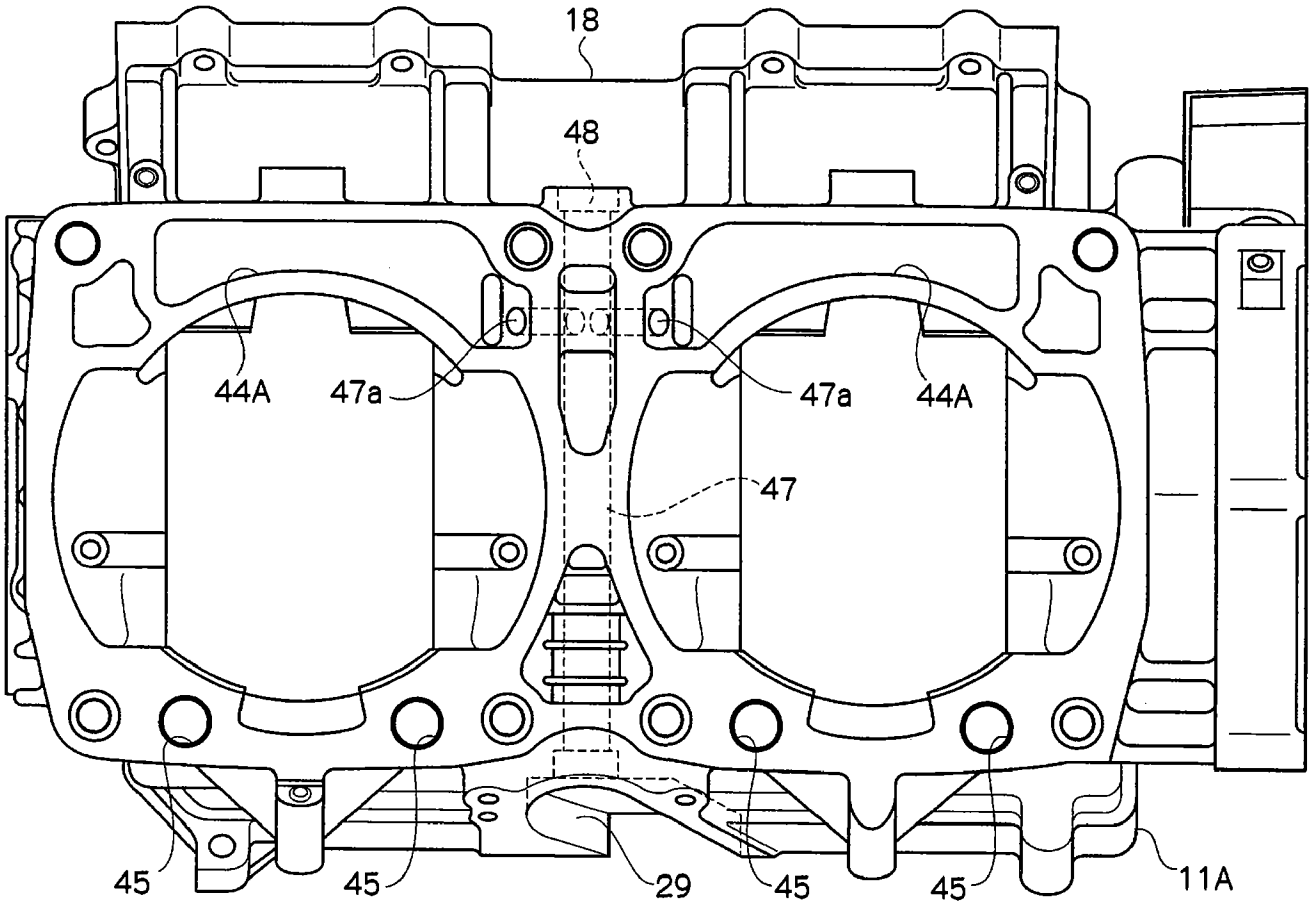
FIG. 8 is a top view of the vicinity of the crankcase of the two-cycle engine in the embodiment of the present invention.
Figure 9A:
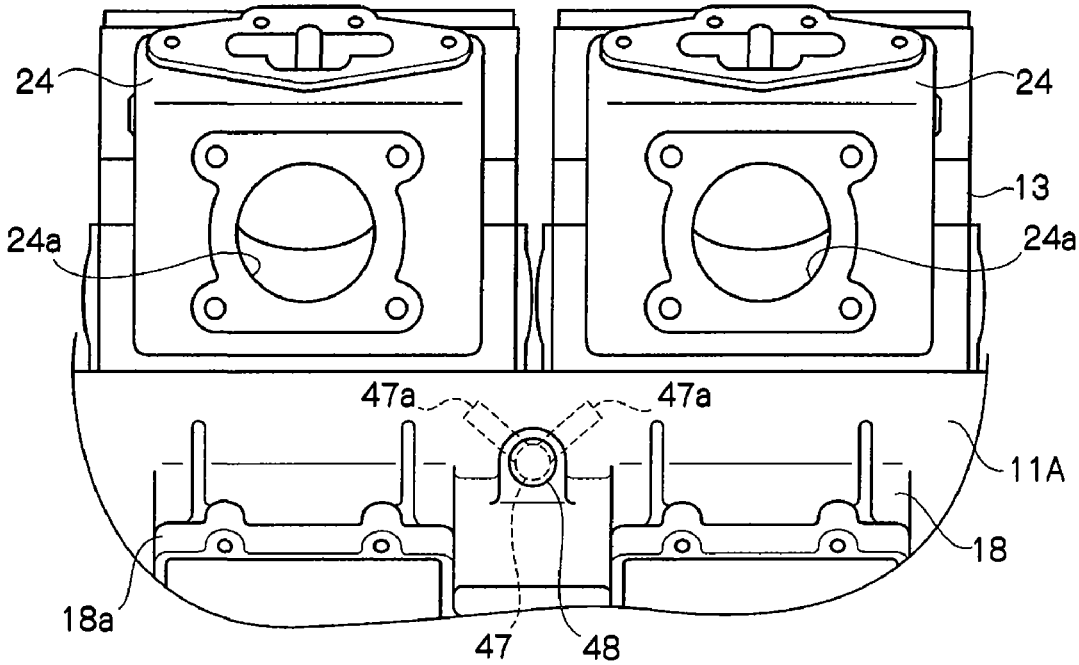
FIG. 9A is a top view and a cross-sectional view of a vicinity of an exhaust port of the two-cycle engine in the embodiment of the present invention.
Figure 9B:
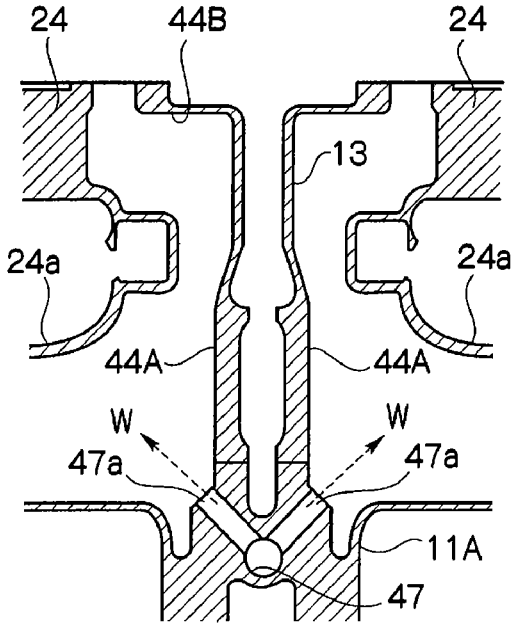
FIG. 9B is a cross-sectional view of the vicinity of the exhaust port of the two-cycle engine in the embodiment of the present invention.

In the cylinder head 14, as shown in FIG. 3, FIG. 5 and the like, the water jacket 37 is formed in a manner to surround a combustion chamber 43 of the inside. Here, in a vicinity of the cylinder 13, there is a water jacket 44A formed near a lower portion of the exhaust port 24*a*. The water jacket 44A is also formed in a region of the crankcase upper 11A as shown in FIG. 8 and the like. The water jacket 37 of the cylinder head 14 is communicated with a water jacket 44B formed in an upper portion of the exhaust port 24*a*, and the water jacket 44B is communicated with a water jacket 44C in a boost port 23 side. Incidentally, as shown in FIG. 9B, the water jacket 44A is communicated with the water jacket 44B.

The water jacket 44C in the boost port 23 side is communicated with a plurality of cooling water passages 45 formed in the crankcase upper 11A as shown in FIG. 6, and the respective cooling water passages 45 are individually communicated with the water jacket 42. At an end portion of the water jacket 42, a cooling water (warm water) outlet portion 46 is formed to project, and the cooling water outlet portion 46 is connected to the heat exchanger 120 via the cooling water hose.

In a cooling structure of an engine according to the present invention, in particular, there is disposed in the crankcase 11 a second cooling water passage 47 which introduces a part of the cooling water discharged from the water pump 26 to the cooling water jacket below the exhaust port 24*a*, that is, to the water jacket 44A.

As shown in FIG. 6 to FIG. 8 and the like, one end side of the second cooling water passage 47 is communicated with the cooling water outlet portion 34 disposed in the cooling water discharging side of the water pump 26, and the second cooling water passage 47 is inclined along a vicinity of a joining face of the crankcase upper 11A (with the cylinder 13) in a manner to ascend forward. The other end side of the second cooling water passage 47 extends to a front surface side of the crankcase upper 11A and is plugged by a plug 48.

The second cooling water passage 47 is formed between the cylinders in the crankcase 11. Near a front of an end portion of a front side of the second cooling water passage 47, there are cooling water outlets 47*a* directed to the right and left exhaust ports 24*a* as shown in FIG. 9A, FIG. 9B and the like. The respective cooling water outlets 47*a* are open at positions obliquely downward from the exhaust ports 24*a* in the water jackets 44A of the respective right and left cylinders, and therefore are communicated with the water jacket 44B and further with the water jacket 44C, which are located thereahead. The two cooling water outlets 47*a* are disposed in almost a V shape as illustrated, and are able to supply cooling water to the right and left cylinders equally in a balanced manner.

Figure 10:
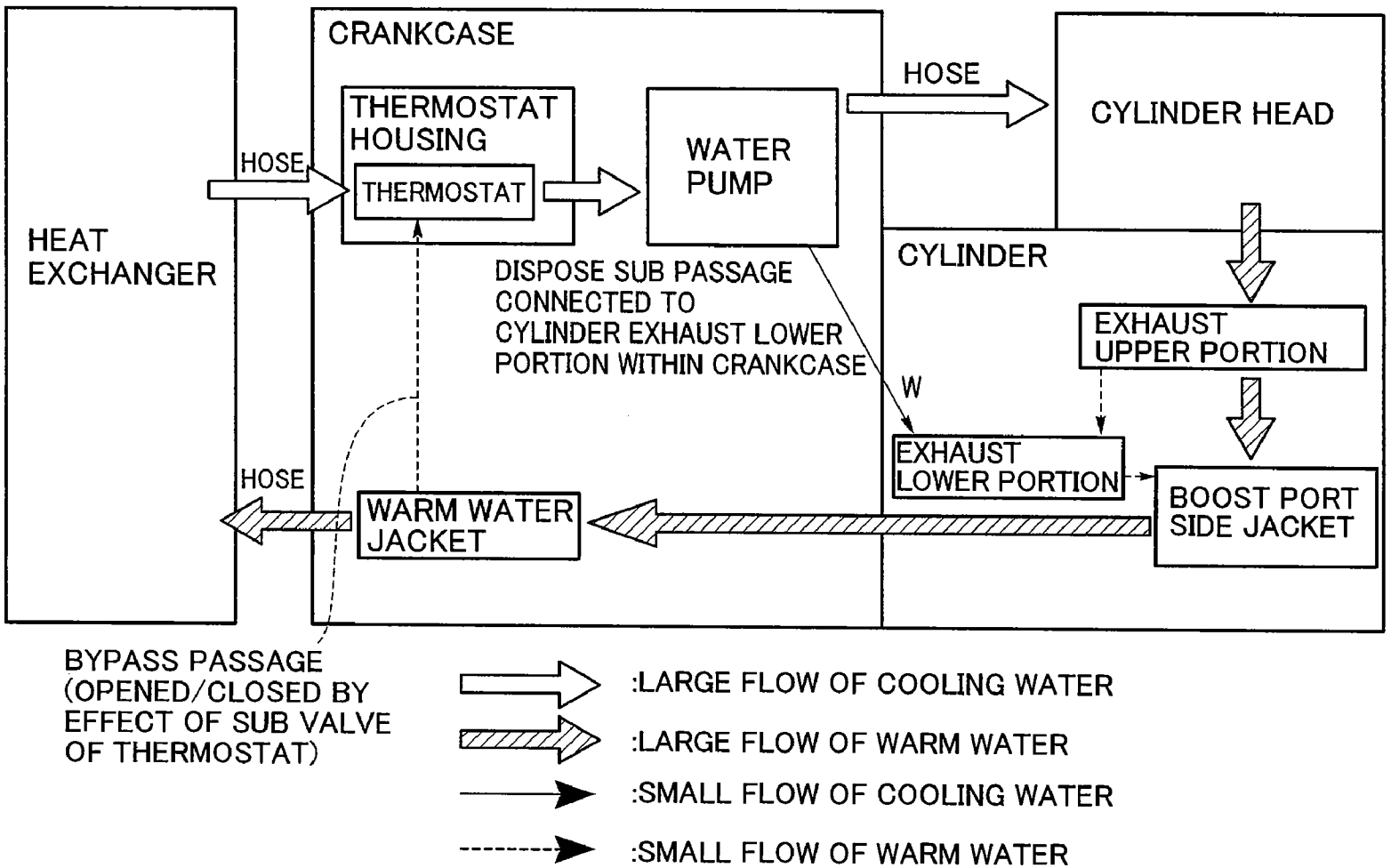
FIG. 10 is a view showing a cooling system of the two-cycle engine in the embodiment of the present invention.

In the above-described construction, an operation of the cooling structure of the two-cycle engine according to the present invention will be described next. Here, FIG. 10 shows a flow of cooling water (or warm water) of the cooling system in the embodiment of the present invention. First, when the cooling water is supplied to the water pump 26 from the heat exchanger 120, the cooling water is introduced to the water pump 26 via the thermostat 41.

The cooling water introduced to the water pump 26 is discharged from the cooling water outlet portion 34, flows through the cooling water hose 35, and is introduced to the engine via the cooling water inlet portion 36 of the cylinder head 14. The introduced cooling water flows through the water jacket 37 in the cylinder head 14 and is distributed to the water jacket 44C mainly via the water jacket 44B in the upper portion of the exhaust port 24*a*. At this time, the introduced cooling water joins the cooling water from the water jacket 44A and subsequently gathers together in the water jacket 42 through the cooling water passage 45, as will be described later.

The warmed cooling water in the water jacket 42 is sent to the heat exchanger 120 through the cooling water hose connected to the cooling water outlet portion 46. Then, the cooling water which is cooled while flowing through the cooling water passage in the heat exchanger 120 is supplied to the water pump 26 again, and sent to the engine and the engine is cooled by repeating the above-described cooling process.

Here, when the engine is in a warm-up state, in the water pump 26, the main valve 41*a* becomes in a state of being blocked and the sub valve 41*b* becomes in a state of being opened by an action of the thermostat 41. At this time, new cooling water is not introduced from a cooling water inlet side of the water pump 26, and warmed cooling water is introduced to the engine main body from the crankcase lower 11B side through the cooling water bypass passage, so that warm cooling water is supplied to an engine side to circulate. Hereby, an effective warm-up drive of the engine can be performed without cooling the engine unnecessarily.

On the other hand, when the engine is in a drive state, in the water pump 26, the main valve 41*a* becomes in a state of being opened and the sub valve 41*b* becomes in a state of being blocked by the action of the thermostat 41, contrary to the time of warm-up drive. At this time, the warmed cooling water is not introduced from the cooling water bypass passage, and only new cooling water is introduced from a cooling water inlet side of the water pump 26. Hereby, the engine which has become high temperature in the drive state can be cooled efficiently.

As described above, the second cooling water passage 47 is provided between the two cylinders of right and left, and a part of the cooling water W discharged from the water pump 26 (see FIG. 5, FIG. 9B and FIG. 10) is introduced to the water jackets 44A below the discharge ports 24*a*. From the two cooling water outlets 47*a* of the second cooling water passage 47, the part of the cooling water W is supplied toward the lower portions of the right and left discharge ports 24*a* equally in a balanced manner.

As described above, by sending the cold cooling water directly to the lower portion of the exhaust port 24*a* from the water pump 26 via the second cooling water passage 47 to perform cooling, a cooling efficiency of a vicinity of the exhaust port 24*a* which becomes high temperature is enhanced, and a heat effect to the air intake port can be reduced. Then, by forcibly cooling the vicinity of the exhaust port 24*a*, allowance for a boiling of the cooling water is increased so that a further high power can be achieved.

Figure 11:
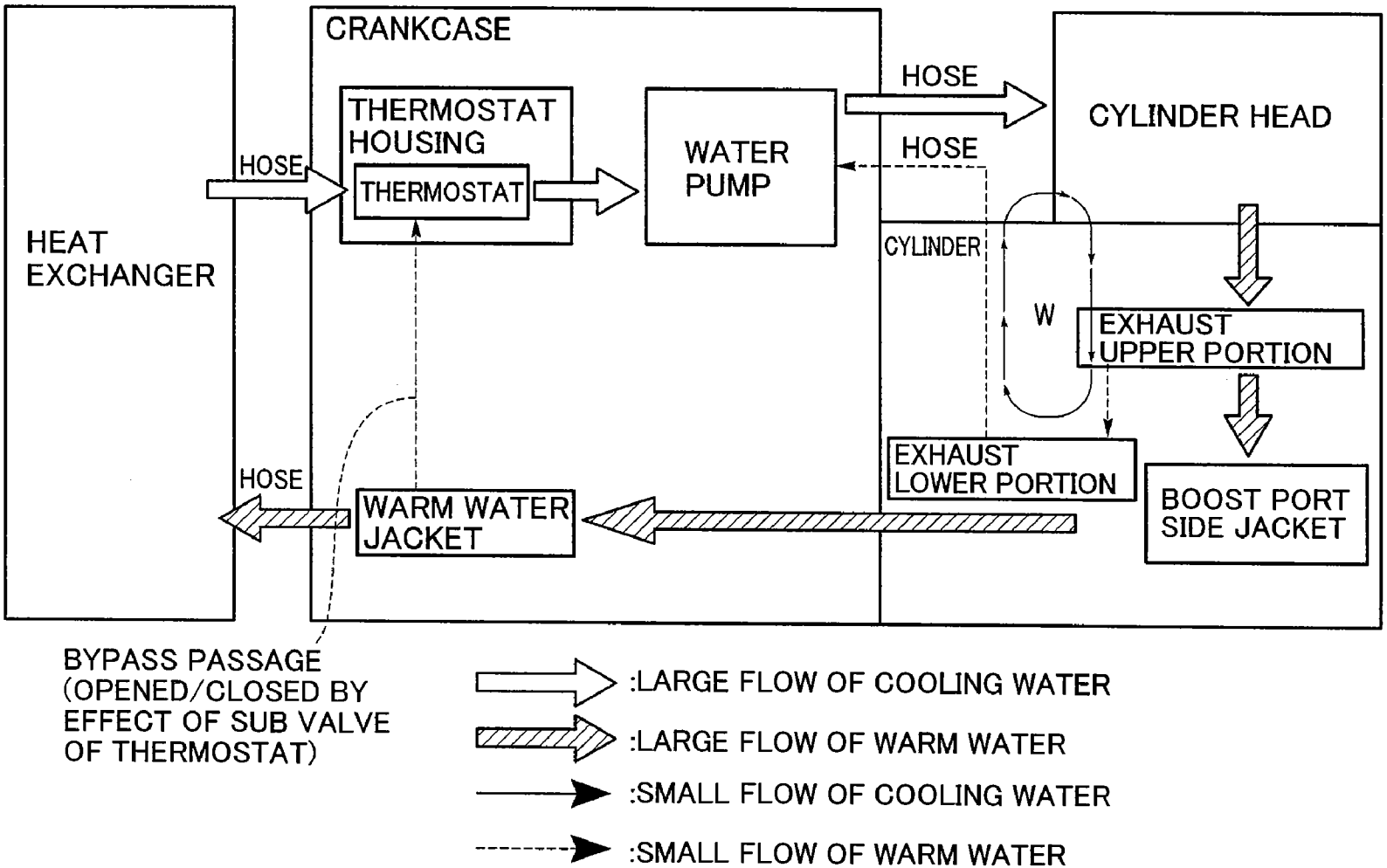
FIG. 11 is a view showing a cooling system of a conventional two-cycle engine.

Incidentally, in order to cool as far as a lower side of the exhaust port, conventionally, as shown in FIG. 11, an amount of the water to be drained to the outside must be increased, and the drained water must be returned to the water pump in the interest of water pressure, resulting that warm water w circulates and causes to reduce a cooling capability as an engine as a whole.

Additionally, by providing the second cooling water passage 47 inside the crankcase 11, a space saving is achieved and an exhaust hose, its union for connection and the like which have been conventionally indispensable can be abolished, so that downsizing of the engine and a cost reduction become possible. In this case, by abolishing the exhaust hose, there is an advantage such that water leakage due to coming off of the hose can be prevented.

By supplying high pressure cooling water to the lower portion of the exhaust port 24*a* collectively to perform cooling, practically only a small amount of cooling water is necessary and most part of the cooling water can be used to cool the cylinder head 14 so that a high cooling effect can be obtained. Moreover, that cooling water is merged into the cooling water from the cylinder head 14 side and is gathered in the water jacket 42 connected to the thermostat 41. Hereby, it is possible to control a circulation amount of the cooling water inside the engine and to precisely manage a cooling water temperature.

When the sub valve 41*b* of the thermostat 41 is closed, circulation within the engine is stopped and the whole amount of the cooling water is sent to the heat exchanger 120. Since the amount returning to the heat exchanger 120 is increased compared with the conventional case, as a result, practically the heat exchanger 120 which is small is sufficiently acceptable. Further, with enhancement of the cooling efficiency, the water pump 26 itself can be downsized, enabling to reduce a power to be consumed, that is, to increase an engine power by that much.

Further, in the ignition device of the two-cycle engine of the present invention, in particular, there are two ignition plugs 17A, 17B disposed parallelly in the forward and backward direction in the cylinder head 14 as described above, and one ignition plug 17A is disposed on almost a cylinder axis, that is, disposed in the central portion of the combustion chamber 43 formed in the cylinder head 14, while the other ignition plug 17B is disposed in a boost port 23 (scavenging port) side opposed to the exhaust port 24*a* formed in a cylinder block.

Figure 12A:
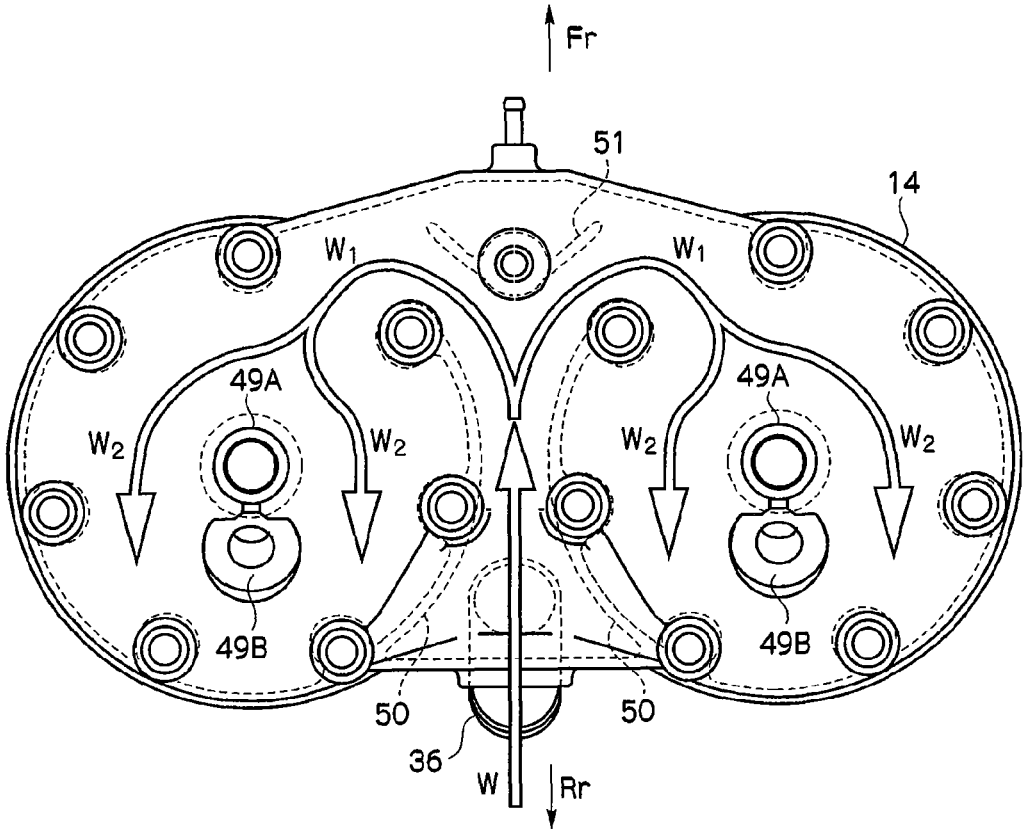
FIG. 12A is a plan view showing an example of a flow of cooling water in a cylinder head in the embodiment of the present invention.
Figure 12B:
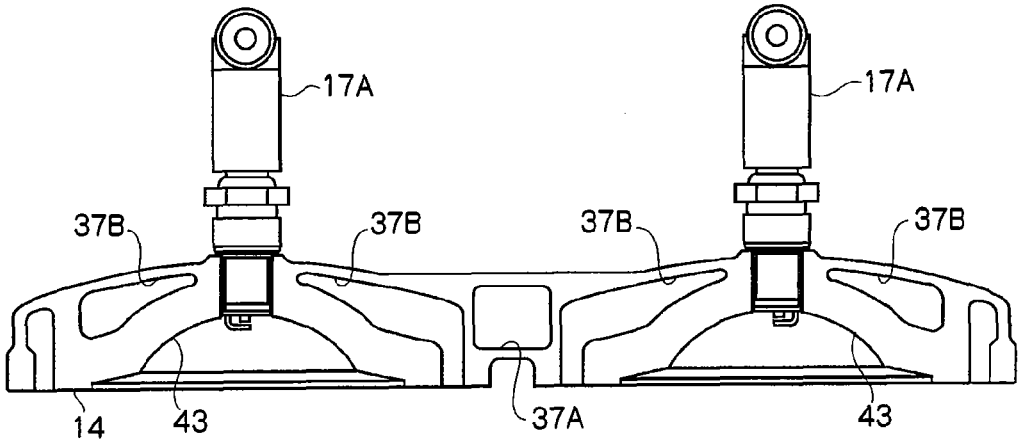
FIG. 12B is a cross-sectional view showing the example of the flow of the cooling water in the cylinder head in the embodiment of the present invention.

Here, FIG. 12A and FIG. 12B show a vicinity of the cylinder head 14. In each cylinder, in the central portion of the combustion chamber 43, an attachment base 49A for attaching the ignition plug 17A is formed, and in a rear Rr side of the attachment base 49A, an attachment base 49B for attaching the ignition plug 17B is formed, respectively. As shown in FIG. 3 and the like, the ignition plug 17A attached to the attachment base 49A is set along the cylinder axis, and the ignition plug 17B attached to the attachment base 49B is set in a manner to be properly inclined in relation to the cylinder axis, that is, in a manner to be directed to the central portion of the combustion chamber 43.

Additionally, in the cooling water jacket 37 formed in the cylinder head 14, a pair of guide ribs 50 are provided in almost a central portion of the cylinder head 14 where the two cylinders are situated next to each other. The guide rib 50 is formed to curve substantially following an arc shape of the cylinder 13 and is disposed to extend from a cooling water inlet portion 36 side to an exhaust port 24*a* side. A cooling water jacket 37A is formed between the pair of guide ribs 50.

In a front Fr side of the guide ribs 50, a guide rib 51 is distantly disposed which has an almost "V" shape when seen from the guide ribs 50 side so that the cooling water jacket 37A is branched into the right and left cylinders by the guide rib 51. The cooling water jacket 37A is branched into the respective cylinders and subsequently cooling water jackets 37B are formed. By providing the guide ribs 50 and the guide rib 51, a flow of the cooling water is restricted to a flow from the exhaust port 24*a* side to the boost port 23 side, as will be described later.

Next, an operation of the ignition device of the two-cycle engine according to the present embodiment will be described. First, the engine unit 10 is started by an unshown starter. In each cylinder, the ignition plugs 17A, 17B are ignited at a predetermined timing, the air-fuel mixture in the combustion chamber 43 (and the cylinder 13) explodes, and the combustion gas is exhausted from the exhaust port 24*a* after the explosion.

During this period, the cooling water is introduced from the heat exchanger 120 to the water pump 26 via the thermostat 41. The cooling water introduced to the water pump 26 is discharged from the cooling water outlet portion 34, flows through the cooling water hose 35 and is introduced to the engine via the cooling water inlet portion 36 of the cylinder head 14. The introduced cooling water flows through the water jacket 37 in the cylinder head 14 and is distributed to the water jacket 44C mainly via the water jacket 44B in the upper portion of the discharge port 24*a*. At this time, the cooling water joins the cooling water from the water jacket 44A and subsequently gathers in the water jacket 42 through the cooling water passage 45.

The warmed cooling water in the water jacket 42 is sent to the heat exchanger 120 through the cooling water hose connected to the cooling water outlet portion 46. Then, the cooling water cooled while passing through the cooling water passage in the heat exchanger 120 is supplied to the water pump 26 again, and sent to the engine and the engine is cooled by repeating the above-described cooling process.

In the ignition device of the present invention, by having two ignition plugs 17A, 17B disposed parallelly in the forward and backward direction in the cylinder head 14, the air-fuel mixture in the combustion chamber 43 and the cylinder 13 is combusted completely so that quite clean exhaust gas can be exhausted from the exhaust port 24*a*. Thereby, the air-fuel mixture which is not combusted completely and exhausted in a state of incomplete combustion in a case of a single ignition plug is eliminated and the combustion efficiency is drastically enhanced.

In this case, the air-fuel mixture is supplied to the cylinder 13 in a manner to be sprayed from the boost port 23 in a direction of the cylinder head 14. The combustion gas is exhausted from the exhaust port 24*a* opposed to the boost port 23. By disposing the ignition plug 17A in the central portion of the combustion chamber 43 and disposing the ignition plug 17B in the boost port 23 side, combustion can be performed along the flow of the air-fuel mixture, so that the air-fuel mixture is combusted completely to form clean exhaust gas.

In particular, the ignition plug 17A disposed in the central portion of the combustion chamber 43 acts effectively to spread the flame evenly in the combustion chamber 43 and the cylinder 13. Meanwhile, as for the ignition plug 17B disposed in the boost port 23 side, disposing the ignition plug 17B in this position acts effectively to combust the air-fuel mixture since dense air-fuel mixture is supplied from the boost port 23.

Here, the cooling water flows from the water pump 26 through the cooling water hose 35 and is introduced to the engine via the cooling water inlet portion 36 of the cylinder head 14. As shown in FIG. 12A, the cooling water W is first distributed toward the front Fr in the cooling water jacket 37A formed by the guide ribs 50. Subsequently, cooling water $W_1$ branched into the right and left cylinders by the guide rib 51 reverses a flow direction and is distributed toward the rear Rr in the cooling water jackets 37B in the respective cylinders. In this case, cooling water $W_2$ is branched in an orderly manner to flow in both sides of the ignition plugs 17A, 17B, and hereby it is possible to cool the vicinity of the cylinder head 14 uniformly and evenly.

As described above, despite having the two ignition plugs 17A, 17B, by disposing them parallelly in the forward and backward direction, a smooth flow of the cooing water ($W_2$) is formed without being hindered by the attachment base 49A and attachment base 49B. Hereby, the cylinder head 14 is effectively cooled to enhance an engine output, and incomplete combustion due to insufficient cooling is prevented, to consequently make the exhaust gas clean.

Figure 13A:
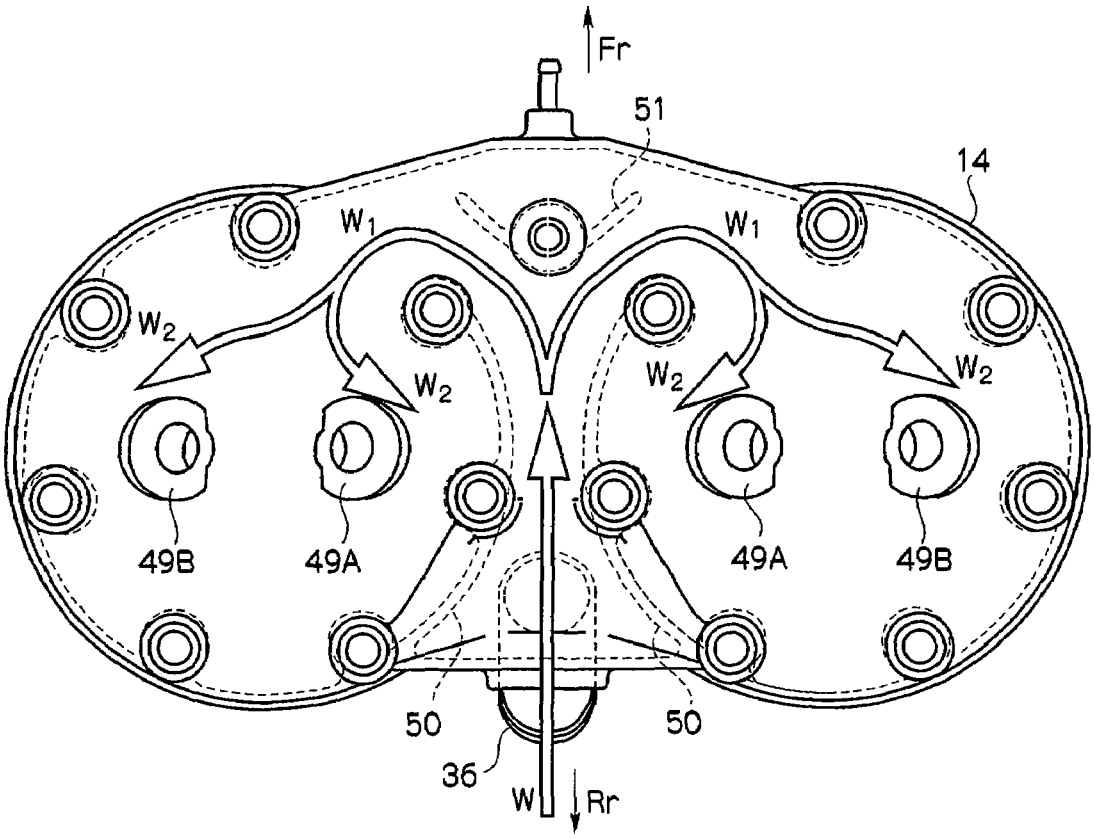
FIG. 13A is a plan view showing a reference example of a flow of cooling water in a cylinder head.
Figure 13B:
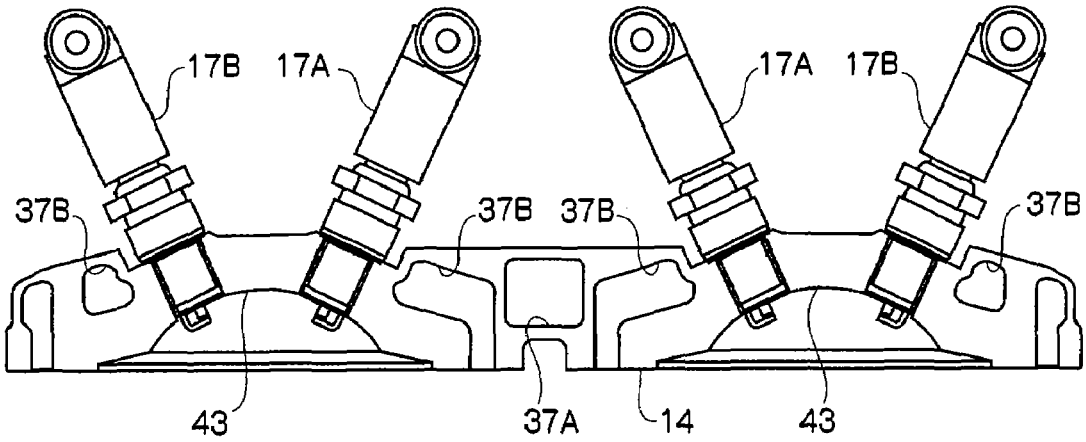
FIG. 13B is a cross-sectional view showing the reference example of the flow of the cooling water in the cylinder head.

Incidentally, if the two ignition plugs 17A, 17B are disposed in the vehicle width direction (right and left direction) by way of experiment as shown in FIG. 13A and FIG. 13B, the cooling water $W_2$ flows as shown in an illustrated example. That is, the cooling water is hindered by the attachment base 49A and the attachment base 49B, and the smooth flow of the cooling water cannot be formed without modification.

Additionally, the exhaust port 24*a* is provided on the upper side of the cylinder 13 which is mounted to be inclined as described above, and the cooling water is made flow from the exhaust port 24*a* side. In this way, by first cooling the exhaust port 24*a* which becomes high temperature, the cooling efficiency can be heightened also in this regard.

Further, by disposing the two ignition plugs 17A, 17B parallelly in the forward and backward direction on a straight line in a vehicle traveling direction, despite being a parallel multicylinder engine, mutual interference between the ignition plugs including a high tension code and the like is eliminated between the right and left cylinders. Additionally, at a time of attaching/detaching the ignition plugs 17A, 17B, such work can be performed without interference between the right and left cylinders, so that workability can be enhanced.

The engine unit 10 having ignition devices as above is mounted on the snow vehicle in a manner that the exhaust port 24*a* faces the vehicle front. Despite having two ignition plugs 17A, 17B, the engine unit 10 can be prevented from becoming large in size, so that a snow vehicle which is compact, high-power, and has clean exhaust gas is realized.

According to the present invention, by sending the cool cooling water directly to the lower portion of the exhaust port from the water pump to perform cooling, the cooling efficiency of the exhaust port is enhanced and the thermal effect to the air intake port can be reduced. Additionally, the exhaust hose, its union for connection and the like which have been conventionally indispensable can be abolished, so that downsizing of the engine becomes possible.

Also, by coping with two cylinders with one cooling water passage, the engine can be prevented from being large. In this case, by directing the cooling water outlet of the second cooling water passage to the right and left exhaust ports, the cooling water directly hits the exhaust ports, so that the cooling effect is considerably enhanced.

Further, at a time of maintenance of the engine, when the cooling water is drained, the cooling water does not stay in the cooling water jacket, and an inconvenience such as flowing of the cooling water into the disassembled engine does not occur at all. Additionally, even if the exhaust port lower portion and the cylinder head are structured independently, the engine is prevented from being large, so that a snow vehicle which is compact and high-power can be realized.

Also, according to the present invention, by having two ignition plugs, the air-fuel mixture in the combustion chamber and the cylinder is combusted completely so that quite clean exhaust gas can be exhausted from the exhaust port. In this case, by disposing one ignition plug in the central portion of the combustion chamber and disposing the other ignition plug in the boost port side, combustion can be performed along the flow of the air-fuel mixture, so that the air-fuel mixture is combusted completely to form clean exhaust gas.

Also, the guide ribs are provided in the cooling water jacket to restrict the flow of the cooling water so that the cooling water is branched in an orderly manner to flow in both sides of the two ignition plugs, and hereby it is possible to cool the vicinity of the cylinder head uniformly and evenly. Despite having two ignition plugs, the smooth flow of the cooing water is formed and the cylinder head is efficiently cooled to enhance the engine output, and incomplete combustion due to insufficient cooling is prevented, to consequently make the exhaust gas clean.

Hereinabove, the present invention is described together with the embodiments, but the present invention is not limited to these embodiments and modification and the like is possible within the scope of the invention.

For example, at an appropriate position in the second cooling water passage 47, a valve capable of adjusting a cooling water amount supplied to the lower portion of the exhaust port 24*a* in response to an operating condition can be provided. Hereby, the cooling water in an amount suitable for a condition of engine output (for example, engine speed and the like) is supplied so that the cooling or cooling water can be managed in high accuracy.

Though there is described the example in which, for example, the two ignition plugs 17A, 17B are disposed parallelly forward and backward on the straight line in the vehicle traveling direction, the ignition plugs can be disposed parallelly forward and backward with an appropriate displacement in the vehicle width direction. Also, both the two ignition plugs can be disposed parallelly forward and backward with an appropriate displacement from the combustion chamber central portion.

Additionally, it is possible to dispose the two ignition plugs to be isolated from each other and to provide a rib between the both ignition plugs so that the cooling water flows to the highest temperature part.

What is claimed is:

1. A water-cooled two-cycle engine mounted on a vehicle, said two-cycle engine comprising:

two ignition plugs in one cylinder head, said two ignition plugs being disposed forward and backward along a direction that is parallel to a vehicle traveling direction, wherein one of said two ignition plugs is disposed at a central portion of a combustion chamber formed in the cylinder head, and the other of said ignition plugs is disposed at a scavenging port side of the cylinder head, the scavenging port side being opposed to an exhaust port side along which an exhaust port is formed in a first cylinder block; and a guide rib provided in a cooling water jacket formed in the cylinder head, said guide rib regulating a flow of cooling water so that the cooling water flows from the exhaust port side of the cylinder head to the scavenging port side.

2. The two-cycle engine according to claim 1, wherein the engine is a multicylinder engine, and wherein a crankshaft is disposed in a vehicle width direction in a crankcase and the first cylinder block is mounted to the crankcase to be inclined, and the exhaust port is provided in an upper portion side of the inclined cylinder block.

3. The two-cycle engine according to claim 1, further comprising:

an air intake port disposed in a crankcase below the exhaust port;

a water pump disposed in the crankcase at a side that is opposite to the side of the exhaust port;

a first cooling water passage introducing a first portion of cooling water discharged from said water pump to a cooling water jacket of a cylinder head; and a second cooling water passage introducing a second portion of the cooling water discharged from said water pump to a cooling water jacket of the first cylinder block below the exhaust port, said second cooling water passage being substantially provided in the crankcase.

4. The two-cycle engine according to claim 3, wherein said second cooling water passage is formed between the first cylinder block and a second cylinder block each affixed to the crankcase, and said second cooling water passage further comprises cooling water outlets directed to the right and to the left along a vehicle width direction toward the exhaust port in the first cylinder block and an exhaust port in the second cylinder block, respectively, said exhaust ports each being provided near an end portion of said second cooling water passage.

5. The two-cycle engine according to claim 1, wherein the engine is mounted on a snow vehicle in a manner that the exhaust port faces a front of the vehicle.

* * * * *